United States Patent [19]

Wong

[11] 4,003,855

[45] Jan. 18, 1977

[54] NONLINEAR RESISTOR MATERIAL AND METHOD OF MANUFACTURE

[75] Inventor: Joe Wong, Schenectady, N.Y.

[73] Assignee: General Electric Company, Schenectady, N.Y.

[22] Filed: June 23, 1975

[21] Appl. No.: 589,430

[52] U.S. Cl. ..... 252/519; 252/518; 252/520; 252/521; 338/20

[51] Int. Cl.[2] ..... H01B 1/08

[58] Field of Search ..... 252/518, 519, 521; 338/20

[56] References Cited

UNITED STATES PATENTS

| | | | |
|---|---|---|---|
| 3,663,458 | 5/1972 | Masuyama et al. | 252/519 X |
| 3,682,841 | 8/1972 | Matsuoka et al. | 252/518 |
| 3,687,871 | 8/1972 | Masuyama et al. | 252/518 |
| 3,903,226 | 9/1975 | Iga et al. | 252/519 X |
| 3,905,006 | 9/1975 | Matsuoka et al. | 252/521 |
| 3,953,373 | 4/1976 | Matsuura et al. | 252/521 X |

*Primary Examiner*—Richard D. Lovering
*Assistant Examiner*—E. Suzanne Parr
*Attorney, Agent, or Firm*—Jack E. Haken; Joseph T. Cohen; Jerome C. Squillaro

[57] ABSTRACT

The zinc oxide grain size and breakdown voltage characteristics of polycrystalline zinc oxide varistors may be controlled by adjusting sintering times and temperatures.

Varistor ceramics formed by sintering constituent metal oxides for long periods are found to have substantially different microstructure from prior art varistors.

8 Claims, 8 Drawing Figures

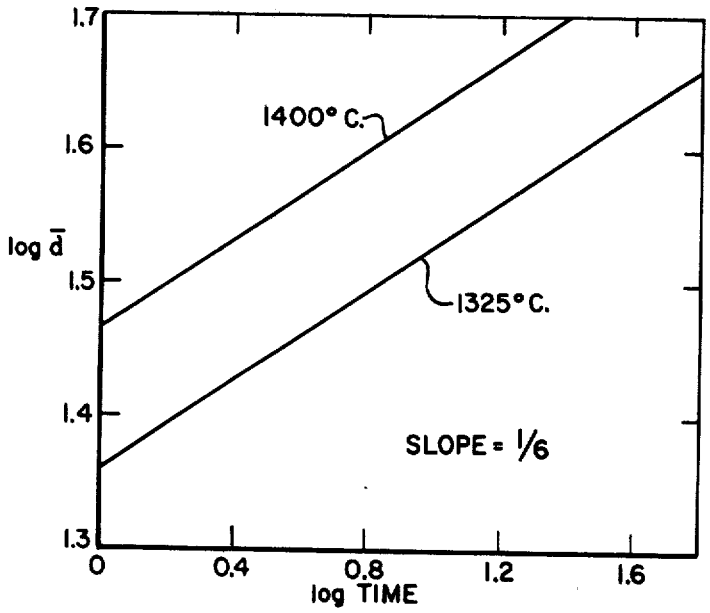
Fig. 1
Fig. 2
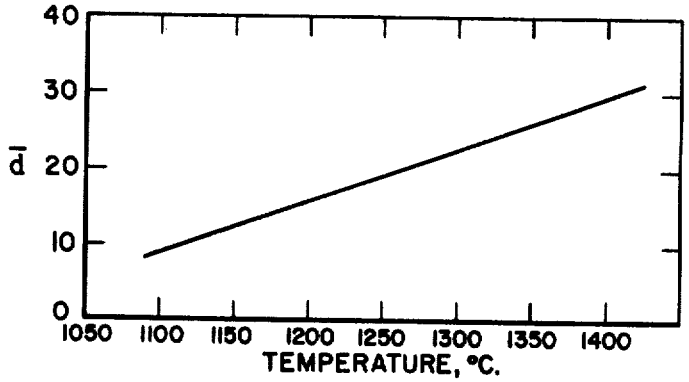
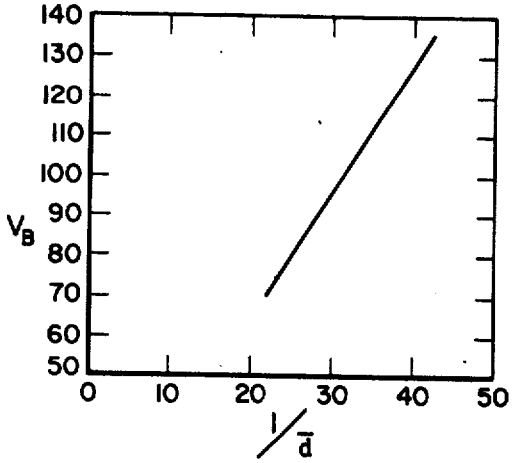
Fig. 3
Fig. 8
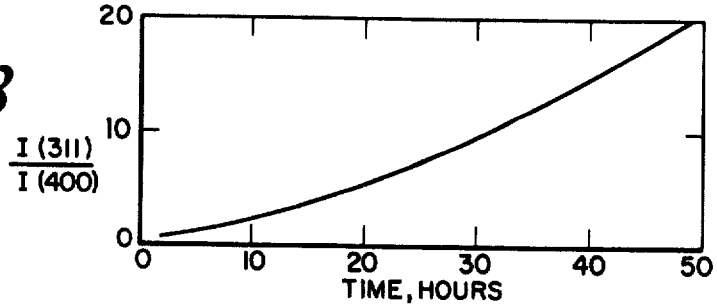

NONLINEAR RESISTOR MATERIAL AND METHOD OF MANUFACTURE

BACKGROUND OF THE INVENTION

This invention relates to nonlinear resistors (varistors) comprising sintered disks of zinc oxide with other metal oxides. More specifically, this invention relates to improved nonlinear resistor materials having low breakdown voltages and leakage currents.

The construction and use of nonlinear resistor materials formed by the sintering of zinc oxide with other metal oxides are described in U.S. Pat. Nos. 3,682,841 to Matsuoka et al. and 3,687,871 to Masuyama which are incorporated by reference in this disclosure.

The electrical characteristics of varistor materials which are of primary importance to design engineers include: Breakdown Voltage ($V_B$), Nonlinear Coefficient ($\alpha$), Leakage Current ($I_L$), Average Grain Size ($\bar{d}$), and Barrier Voltage ($v_b$). As used below the term "Breakdown Voltage ($V_B$)" means the voltage gradient necessary to produce a current density of $10^{-3}$ amps $cm^{-2}$. "Nonlinear Coefficient ($\alpha$)" is defined by the formula $$\alpha = \frac{\log_{10}(I_2/I_1)}{\log_{10}(V_2/V_1)}$$

Where $V_1$, $V_2$ and $I_1$, $I_2$ respectively are the voltage gradient and corresponding current density values taken at points within the region of nonlinear resistor operation characterized by a power law voltage-current relationship $$I = (V/C)^{\alpha}$$

For the compositions discussed below, $I_1$ is typically $10^{-5}$ amp $cm^{-2}$ and $I_2$ is $10^{-3}$ amp $cm^{-2}$. "Leakage Current ($I_L$)" is the current density at a voltage gradient equal to one half the breakdown voltage ($V_B$). "Barrier Voltage ($v_b$)" is a statistical parameter calculated by multiplying the breakdown voltage ($V_B$) by the average zinc oxide grain size ($\bar{d}$) as determined by microscopic examination.

Nonlinear electrical resistors presently offered for sale have nonlinear coefficients ($\alpha$) of approximately 50 and breakdown voltage ratings on the order of 120 volts $mm^{-1}$. The structure of these ceramic materials was known to constitute an aggregation of zinc oxide crystals dispersed in an intergranular medium but specific details of the microstructure and conduction mechanism remained substantially unknown.

It is desirable, for the production of useful circuit components, to produce nonlinear resistor materials having breakdown voltage ratings lower than the 120 volts $mm^{-1}$ presently available. Previous attempts to produce these breakdown voltage ratings have, however, yielded materials having poorly defined breakdown characteristics, low nonlinear coefficient ($\alpha$), and high values of leakage current. These materials have poorly defined breakdown voltage curves and must dissipate considerable power when operated below breakdown voltage. They are, therefore, generally unsuitable for use as transient and overvoltage suppressors, a major field of varistor application.

SUMMARY OF THE INVENTION

I have discovered further information relating to the microstructure relevant to conduction mechanisms within nonlinear zinc oxide resistor materials which has allowed production of materials having low breakdown voltage ($V_B$) while retaining high nonlinear coefficients ($\alpha$), well-defined voltage breakdown characteristics, and low leakage currents ($I_L$).

It is now known that the breakdown voltage characteristics in metal oxide varistor materials are determined by mechanisms acting at the boundaries of the individual zinc oxide grains. The breakdown voltage characteristic of a given structure is a statistical function proportional to the individual grain barrier voltage ($v_b$) and the number of zinc oxide grains lying between measurement points. I have discovered that the breakdown voltage of a given material mixture may be decreased by increasing the size of the zinc oxide grains.

In accordance with the methods of this invention, the zinc oxide grain size in polycrystalline zinc oxide varistor materials is found to be a function of the sintering time and the sintering temperature used in the manufacture of those materials. The breakdown voltage ($V_B$) of a polycrystalline zinc oxide varistor material may, therefore, be controlled as a function of the sintering time and of the sintering temperature of that material.

I have determined that the average zinc oxide grain size in zinc oxide varistors varies in proportion to the sintering temperature for temperatures in the range from approximately 1000° C to 1415° C. I have also determined that the average zinc oxide grain size is proportional to the sintering time raised to 1/6 power over a time range from approximately one hour to approximately 48 hours. The individual grain barrier voltage ($v_b$) is invariant with sintering temperature and decreases only slightly with sintering time. The leakage current of varistor materials increases slightly with sintering time but remains much less than the leakage current in prior art, low voltage zinc oxide varistor materials.

The microstructure of prior art polycrystalline zinc oxide varistor materials included grains of zinc oxide, spinel particles, and a pyrochlore intergranular phase. Zinc oxide varistor materials produced with the long sintering time methods of the present invention are characterized by the absence of a detectable, intergranular pyrochlore phase and, therefore, represent a new and distinct composition of matter.

BRIEF DESCRIPTION OF THE DRAWINGS

The novel features believed to be characteristic of the invention are set forth in the appended claims. The invention itself, together with further objectives and advantages thereof, may best be understood with reference to the following detailed description, taken in connection with the appended drawings in which:

FIG. 1 is a logarithmic plot of the average zinc oxide grain size in materials produced in accordance with the present invention as a function of sintering time;

FIG. 2 is a plot of the average zinc oxide grain size in materials produced in accordance with the methods of the present invention as a function of sintering temperature;

FIG. 3 is a plot of the breakdown voltage of zinc oxide varistor material produced in accordance with the present invention as a function of inverse average zinc oxide grain size;

FIG. 8 is a plot of the spinel/pyrochlore ratio versus sintering time for varistor materials produced in accordance with the present invention.

DESCRIPTION OF THE PREFERRED EMBODIMENT

Figure 4:
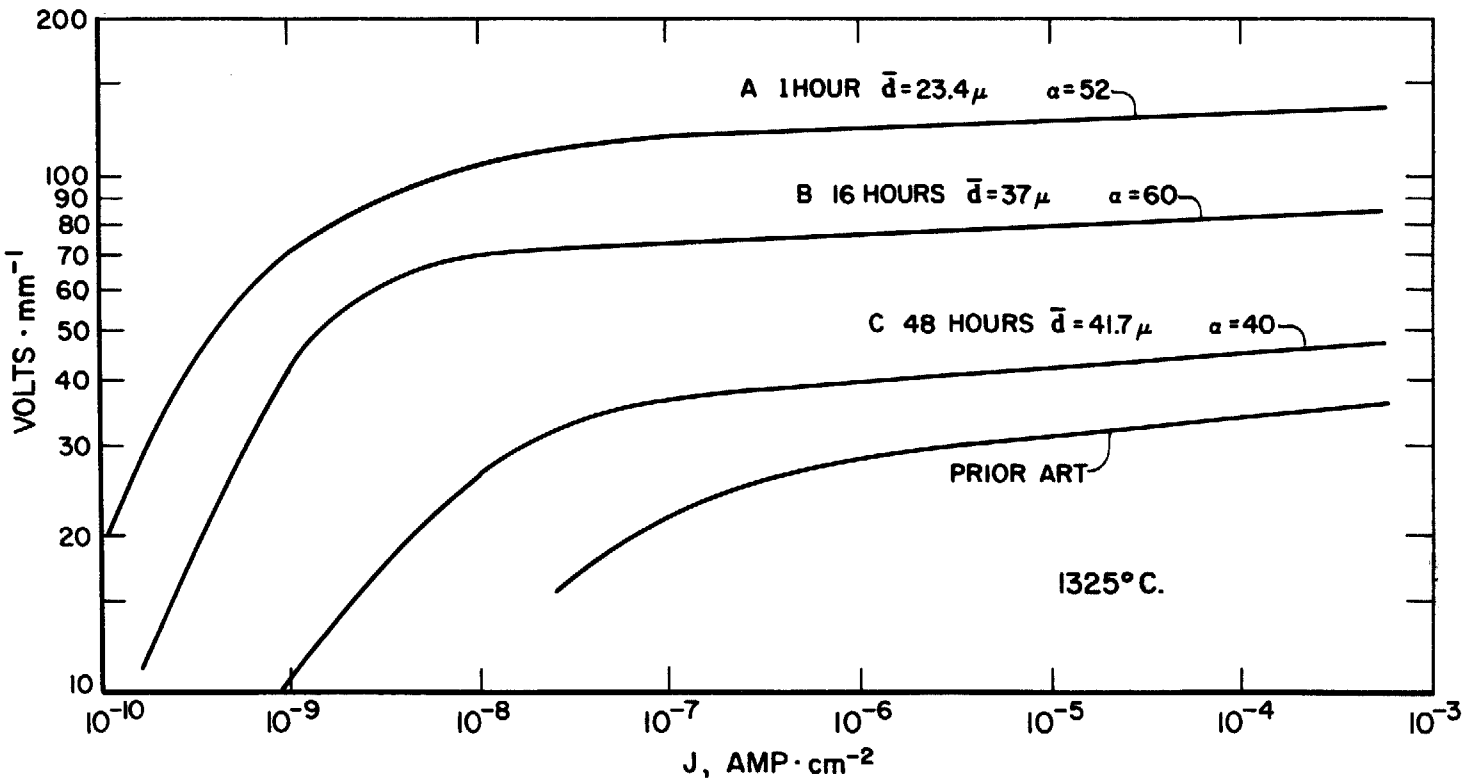
FIG. 4 is a logarithmic plot of the voltage-current characteristics of zinc oxide polycrystalline varistors produced in accordance with the sintering time variation methods of the present invention.

Prior art polycrystalline zinc oxide varistor materials may comprise a ceramic formed by sintering zinc oxide (ZnO), and bismuth oxide ($Bi_2O_3$) with transition or post-transition metal oxides at temperatures between 1000° C and 1450° C for one hour. My investigations of the microstructure of the above-mentioned ceramics have indicated a three phase system comprising zinc oxide grains, spinel particles, and an intergranular amorphous, pyrochlore phase. The nonlinear voltage-current effect characteristic of these varistor materials is known to occur at the boundaries of the zinc oxide grains; the breakdown voltage of a polycrystalline zinc oxide varistor is, therefore, proportional to the number of zinc oxide grains per unit length and inversely proportional to the size of the zinc oxide grains. A more complete description of the microstructure of polycrystalline zinc oxide varistors and the relation between that microstructure and associated electrical characteristics is contained in my co-pending U.S. Pat. application Ser. No. 520,569, now abandoned of common assignee, which is incorporated herein by reference.

Prior art methods for producing zinc oxide varistors with low voltage breakdown characteristics have principally depended on tailoring the specific chemical composition of the material to promote zinc oxide grain growth. I have discovered that the sintering process parameters, specifically the sintering time and the sintering temperature, directly affect the zinc oxide grain size and the voltage breakdown characteristics of the varistor material produced and that these parameters may be adjusted to tailor the voltage breakdown characteristics of varistor materials for specific applications.

In accordance with the present inventions, a varistor material comprising approximately 97 mol percent zinc oxide, ½ mol percent bismuth oxide, 1 mol percent antimony oxide, ½ mol percent tin oxide and traces of cobalt oxide, manganese oxide, barium carbonate, and boric acid is compressed into samples and sintered for varying lengths of time at temperatures of 1325° C and 1400° C. The average zinc oxide grain size characteristic of these samples is plotted as a function of sintering time in FIG. 1. The average zinc oxide grain size produced at both sintering temperatures is found to vary as a function of the sintering time raised to the 1/6 power. The electrical characteristics of materials produced in accordance with this method are described below.

FIG. 2 is a plot of the average zinc oxide grain size characteristic of the above-described samples as a function of sintering temperature for a one hour sintering time. The average zinc oxide grain size in these polycrystalline zinc oxide varistor materials is found to increase in proportion to the sintering temperature over the range from 1100° C to 1400° C. The variations in electrical characteristics of the varistor material with sintering temperature are likewise described below.

FIG. 3 is a plot of the breakdown voltage ($V_B$) of the polycrystalline varistor material of the above-described composition as a function of inverse zinc oxide grain size ($1/d$). For a given chemical composition the breakdown voltage characteristic ($V_B$) is found to be an inverse function of the average zinc oxide grain size.

FIG. 4 is a logarithmic plot of the breakdown voltage characteristic ($V_B$) versus current density for materials produced in accordance with above described abovedescribed preferred embodiment of the present invention. Plot A is characteristic of prior art materials which were sintered at 1325° C for one hour. The material exhibits a breakdown voltage of 135.7 V $mm^{-1}$, an exponent ($\alpha$) of 52 and an average zinc oxide grain size ($\bar{d}$) of 23.4 microns.

Plot B is characteristic of a polycrystalline varistor material sintered from the identical chemical constituent used for the material characterized in Plot A at a temperature of 1325° C with a sintering time of 16 hours. The breakdown voltage characteristic ($V_B$) decreases with increased sintering time to 83.0 V $mm^{-1}$. The exponent ($\alpha$) of this material is approximately 60 and the average zinc oxide grain size ($\bar{d}$) increases to approximately 37 microns.

Plot C is characteristic of the same material sintered at 1325° C for 48 hours. The breakdown voltage characteristic of this material is reduced to approximately 46 V $mm^{-1}$ while the average zinc oxide grain size is increased to 41.7 microns.

By way of comparison, a plot of the voltage-current characteristics of a prior art low voltage polycrystalline material produced by chemical variation of the constituent materials is indicated in FIG. 4. The varistor materials produced in accordance with the methods of the present invention are seen to exhibit significantly lower leakage currents ($I_L$) than these prior art materials. The electrical characteristics of the materials of the present invention characterized in FIG. 4 are summarized in Table I.

Table I

| Sintering Time (Hrs.) | d ($\mu$) | $V_B$ V $mm^{-1}$ | $\alpha$ | $I_L$ (amps) |
|---|---|---|---|---|
| 1 | 23.4 | 135.7 | 52 | $8 \times 10^{-10}$ |
| 16 | 37.0 | 83.0 | 60 | $2 \times 10^{-9}$ |
| 48 | 41.7 | 46.8 | 40 | $5 \times 10^{-9}$ |

Chemical constituents of varistor ceramics, notably bismuth compounds, tend to volatilize during long sintering periods and to thereby degrade the electrical characteristics of the resultant material. In accordance with the methods of the present invention, the constituent metal oxides are pressed to form flat disks which are stacked face-to-face during sintering. The tendency for volatilization of constituent chemical compounds is thereby reduced.

The breakdown voltage characteristic of zinc oxide varistors produced in accordance with the present invention may, therefore, be adjusted by increasing or decreasing the sintering time of the ceramic material in the range from one to 48 hours. The total breakdown voltage of the particular varistor disk is, of course, dependent upon the product of the breakdown voltage ($V_B$) multiplied by the thickness of the varistor disk. Fine control of an individual varistor breakdown voltage may, therefore, be obtained by lapping the thickness of the varistor disk until the desired breakdown voltage is obtained between the opposed faces.

Figure 5:
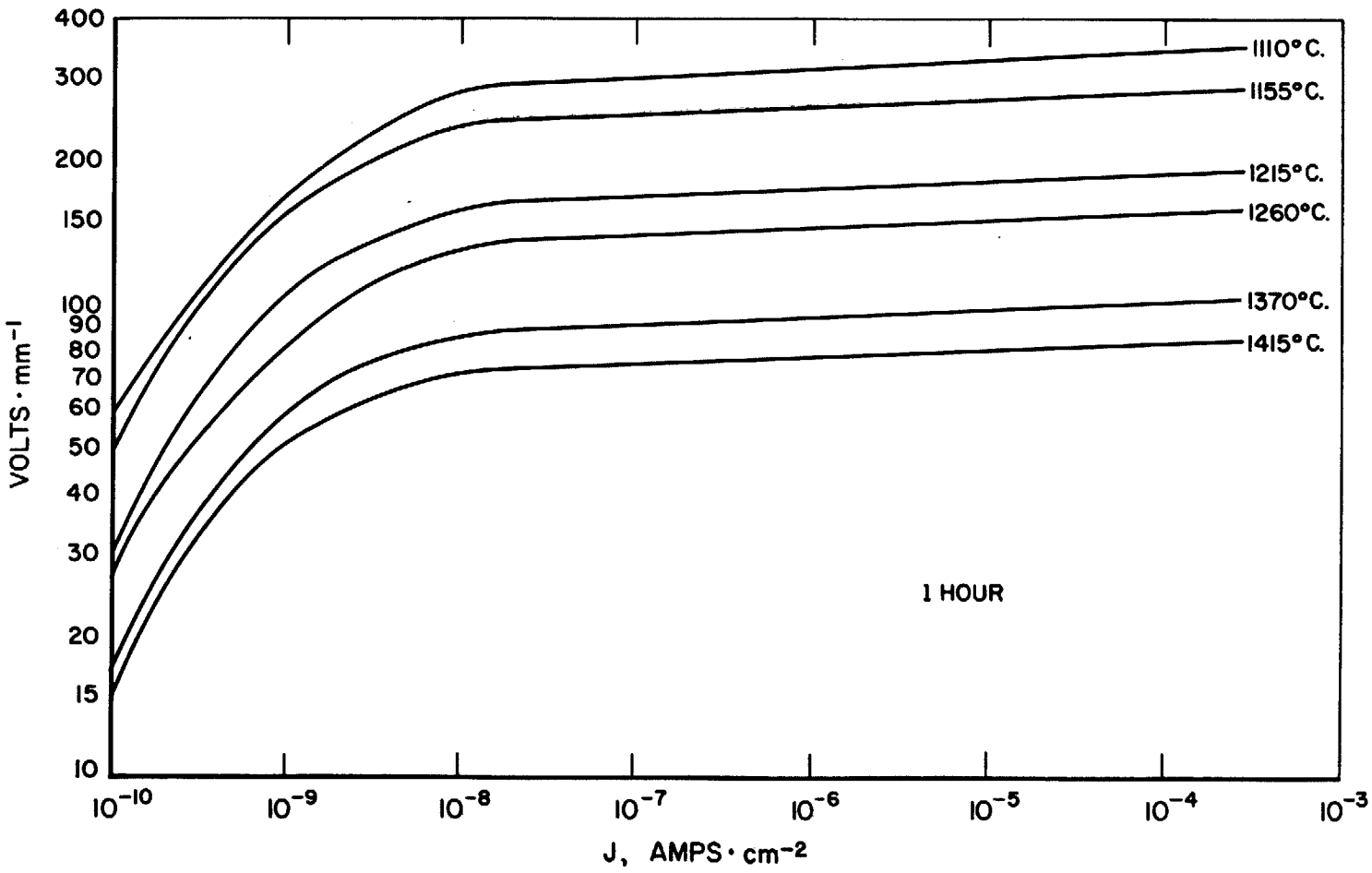
FIG. 5 is a logarithmic plot of the voltage-current characteristics of polycrystalline zinc oxide varistor material produced in accordance with the temperature variation methods of the present invention.

The average zinc oxide grain size and the voltage breakdown characteristic of zinc oxide varistor materials has also been found to vary as a function of sintering temperature. FIG. 5 is a family of logarithmic plots of the breakdown voltage-current characteristics of a varistor material compostion having the chemical constituents described above, produced by sintering for one hour at temperatures ranging from 1110° C to 1415° C. The electrical characteristics of the resultant material may be seen to exhibit uniformly low leakage currents and high alpha characteristics while the breakdown voltage is found to vary in inverse proportion to sintering temperature. For sintering temperatures above 1415° C, the exponent ($\alpha$) is found to decrease while the leakage current characteristics increase markedly.

Figure 6:
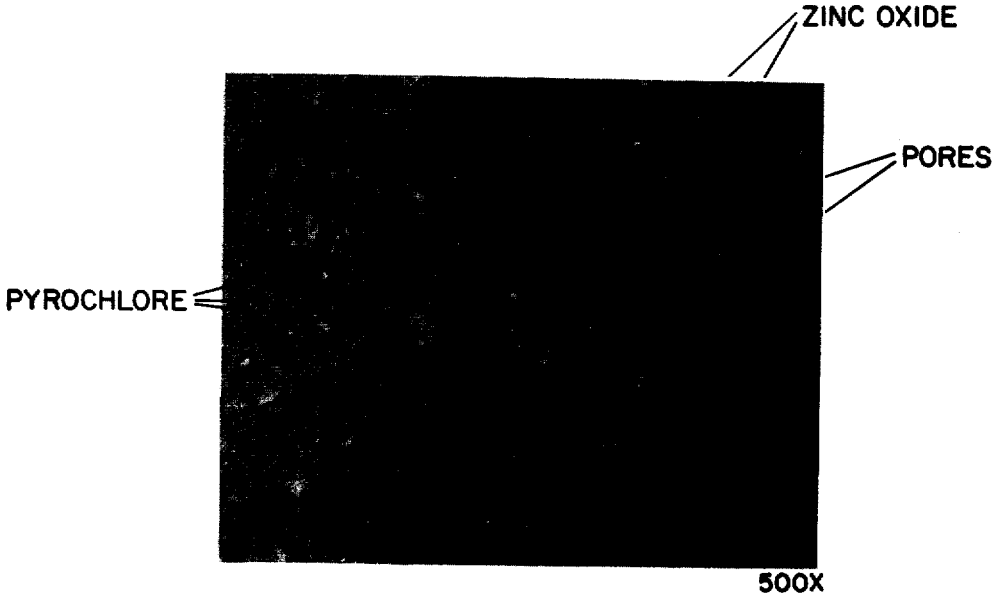
Fig. 6 (PRIOR ART)
FIG. 6 is a surface micrograph of a polycrystalline zinc oxide varistor of the prior art.

Microscopic and x-ray diffraction investigation of polycrystalline zinc oxide materials produced by sintering for periods of forty-eight hours and more have indicated that these materials differ significantly in microstructure and phase equilibrium characteristics from the polycrystalline varistors produced in accordance with the previously referenced patents. FIG. 6 is an optical micrograph of a polished surface of a prior art varistor formed by sintering approximately 97 mol percent zinc oxide, ½ mol percent bismuth oxide, 1 mol percent antimony oxide, and ½ mol percent tin oxide, together with traces of cobalt oxide, manganese oxide, barium carbonate, and boric acid for one hour at 1300° C. The microstructure of these materials are characterized by zinc oxide grains and spinel particles separated by an intergranular phase which my investigations have shown to be related to the anion deficient pyrochlore $Bi_2Zn_{4/3}Sb_{2/3}O_6$, in which the $Sb_2O_3$ to $Bi_2O_3$ molar ratio is ⅓.

Figure 7:
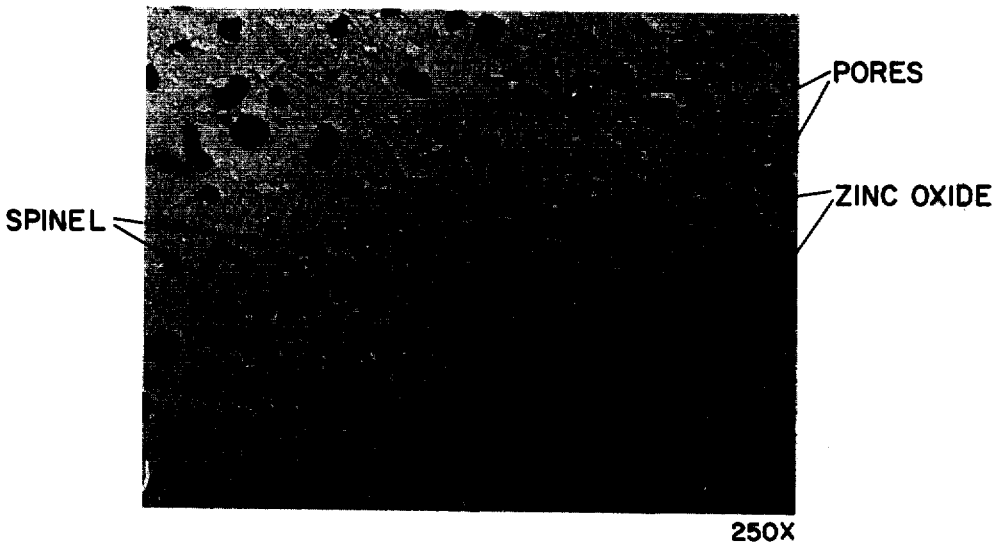
FIG. 7 is a surface micrograph of a polycrystalline zinc oxide varistor sintered for 48 hours in accordance with the present invention.

FIG. 7 is a similar optical micrograph of the surface of a ceramic formed by sintering these materials for forth-eight hours. The microstructure of materials formed during long sintering times is characterized by the notable absence of a significant pyrochlore phase. This variation in structure with sintering time is confirmed by x-ray diffraction data. The decrease in pyrochlore content with sintering time is illustrated by FIG. 8 which is a plot of the ratio of the relative intensities of the (311) x-ray diffraction peak, characteristic of a spinel phase, to the (400) x-ray diffraction peak, characteristic of the pyrochlore phase. For sintering times in excess of 48 hours the pyrochlore content decreases below the limiting resolution of the x-ray apparatus. Chemical analysis likewise indicates the absence of pyrochlore residue in dissolved varistors manufactured with long sintering times.

Although specific data in respect to voltage-current characteristics are grain size has been presented herein with respect to a preferred embodiment of varistor compositions, my investigations of other varistor compositions have indicated that breakdown voltage and grain size are likewise functions of sintering time and sintering temperature.

The effectiveness of the method of the present invention is most pronounced in ceramics containing grain growth inhibitors, for example tin or antimony. A discussion of the effects of these elements is contained in my above-referenced U.S. patent application. The effect is also significant in other compositions, however, for example, a low breakdown voltage ceramic formed by sintering ZnO with 0.5 mol percent each of $Bi_2O_3$, $CO_3O_4$, $MnO_2$ and 0.1 mol percent each BaO and $B_2O_3$. This composition exhibits a breakdown voltage ($V_B$) of approximately 24 volts $mm^{-1}$ when sintered at 1340° C for one hour and of approximately 20volts $mm^{-1}$ when sintered for approximately 8 hours. The average zinc oxide grain size after sintering this material for 8 hours is 74$\mu$.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A method of controlling the breakdown voltage of a polycrystalline zinc oxide varistor of the type comprising a sintered mixture of zinc oxide, bismuth oxide, and materials selected from the group consisting of transition metal oxides and post-transition metal oxides comprising the step of sintering said mixture at a temperature between approximately 1100° C and approximately 1415° C for a period of time between 1 hour and approximately 48 hours, said period of time being chosen as an inverse function of a desired breakdown voltage characteristic of said varistor whereby the zinc oxide grain size in said varistor is caused to vary in approximate proportion to the one-sixth power of said period of time.

2. The method of claim 1 further comprising the steps of:

pressing said mixture into cylinder forms, said cylinder forms having flat, parallel faces, and stacking and retaining said cylinder forms face to face during said sintering step.

3. A varistor material manufactured by forming a mixture of zinc oxide, bismuth oxide, and materials selected from the group consisting of transition metal oxides and post-transition metal oxides and sintering said mixture at a temperature between approximately 1100° C and approximately 1415° C for a period of at least forty-eight hours.

4. The varistor of claim 3 manufactured by sintering said mixture at 1325° C.

5. The varistor of claim 3 manufactured by sintering said mixture for 48 hours.

6. The varistor of claim 3 further characterized by the absence of a structurally significant pyrochlore phase.

7. The varistor of claim 6 wherein said mixture comprises antimony oxide, tin oxide, cobalt oxide, and manganese oxide.

8. The varistor material of claim 7 comprising 97 mol percent zinc oxide, ½ mol percent bismuth oxide, 1 mol percent antimony oxide, ½ mol percent tin oxide, and traces of cobalt oxide, manganese oxide, barium carbonate and boric acid.

* * * * *